United States Patent [19]

Spinner

[11] 4,349,793

[45] Sep. 14, 1982

[54] ADJUSTABLE DIRECTIONAL COUPLER HAVING TILTABLE COUPLING CONDUCTOR

[76] Inventor: Georg Spinner, Am Eichberg 12, D-8152 Feldkirchen-Westerham 1, Fed. Rep. of Germany

[21] Appl. No.: 208,276

[22] Filed: Nov. 19, 1980

[30] Foreign Application Priority Data

Nov. 21, 1979 [DE] Fed. Rep. of Germany ..... 2946989

[51] Int. Cl.[3] ..... H01P 5/04; H01P 5/18

[52] U.S. Cl. ..... 333/111; 333/115

[58] Field of Search ..... 333/109, 111, 115

[56] References Cited

U.S. PATENT DOCUMENTS 3,105,207 9/1963 Capewell et al. ..... 333/111
3,166,723 1/1965 Block et al. ..... 333/111
3,363,201 1/1968 Isaacson ..... 333/111
4,001,730 1/1977 Spinner ..... 333/111

*Primary Examiner*—Paul L. Gensler
*Attorney, Agent, or Firm*—Ostrolenk, Faber, Gerb & Soffen

[57] ABSTRACT

A directional coupler for coupling between four inner conductors 16,18,20,22 of four coaxial lines has two coupling conductors 10,12 which are connected across respective pairs of inner conductors 20,22,16,18, and are spaced apart to define a coupling gap 14. The width of the coupling gap can be varied by tilting movement of one, and preferably both coupling conductors which are attached to the respective inner conductors by tilting joints in the form of leaf springs 124. A modification (FIGS. 4,5) enables the coupler to be used for crossed coaxial lines.

14 Claims, 5 Drawing Figures

ADJUSTABLE DIRECTIONAL COUPLER HAVING TILTABLE COUPLING CONDUCTOR

Figure 1:
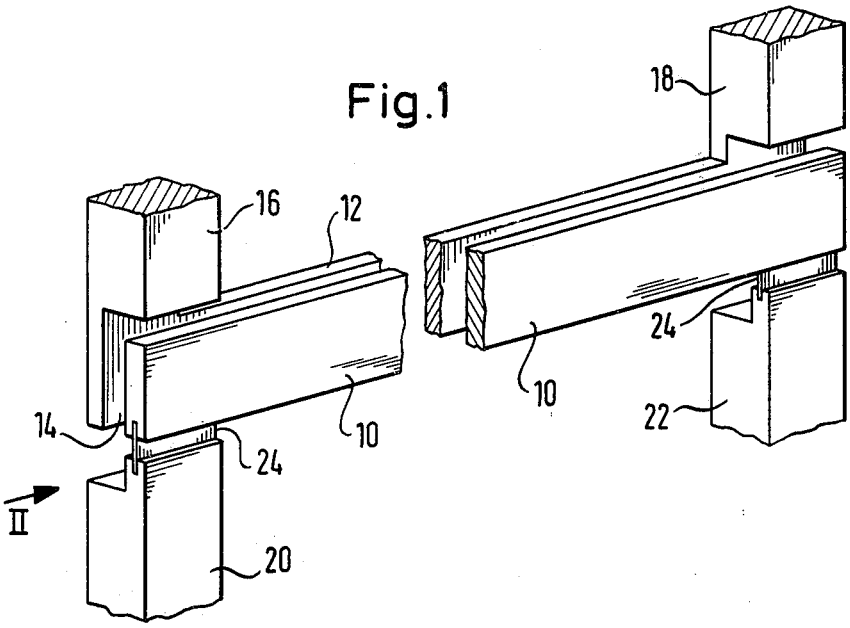

The invention relates to a directional coupler having band-like coupling conductors guided in air and with coupling into both sides of the coupling conductors. In a known directional coupler of this kind, the coupling attenuation can be varied by adjusting the mutual separation of the coupling conductors to vary the coupling gap defined therebetween. The central plane of the coupling gap formed between the broad sides of the coupling conductors includes the axes of the coaxial conductor system and can be adjusted by means of mechanical adjusting members. The coupling conductors are rigidly constructed and secured via resiliently deformable members to fixedly arranged terminal ends of the inner conductors of the coaxial lines. The resiliently deformable members allow movement of the coupling conductors relative to the terminal ends of the inner conductors.

Directional couplers of this kind which are known from German Pat. No. 24 34 144 make it possible, in a space-saving construction, to vary the coupling attenuation by sensitive adjustment of a coupling gap which is of constant cross-section over the whole length of the coupling. Moreover, it is possible to use almost the entire length of the housing for the coupling conductors so that the dimensions of the housing of the coupler depend essentially only on the length of the coupling conductors.

In the arrangement of the above-mentioned German patent, the resiliently deformable members are, however, constructed in such a way that relative movement of the coupling conductors occurs in the direction of the associated inner conductors of the coaxial lines. Provision has to be made to accommodate this movement and leads to an increase in the complexity of the coupler.

The principal object underlying the present invention is to be able to sensitively adjust the coupling gap within wide limits without producing a radial displacement of the inner conductor sections and to ensure a simple mechanical construction. This object is accomplished by an arrangement in which the resiliently deformable members form tilting joints the axes of tilting of which extend parallel to the axes of the coupling conductors, i.e. to the axis of the coupling gap.

The fact that the coupling conductor is tilted means that the terminals can be rigidly constructed so that no radial displacement of the inner conductor sections is necessary. In this connection the arrangement can be such that a tilting movement of one of the coupling conductors results in the two coupling conductors being mutually inclined to one another.

In order to avoid this inclined position both coupling conductors can be tiltable with respect to one another in such a way that their coupling planes remain parallel in every tilted position.

The tilting joints which are usefully formed by leaf springs can be arranged, in accordance with a first embodiment of the invention, between the inner conductor terminals of the coaxial lines and the coupling conductors in place of the parallel bands provided in the aforementioned German patent. This arrangement means that the coaxial lines leading to each coupling conductor must be arranged on the same side of the coupling gap. It is, however, frequently desirable for the coupling conductors to cross over each other i.e. for the inner conductor terminals associated with each coupling conductor to be arranged on opposite sides of the coupling conductor.

This situation can be catered for by an arrangement in which a resiliently deformable member in the form of a leaf spring is clamped at two oppositely disposed sides in clamping slots formed in at least one of the coupling conductors and a fixed conductor section which extends parallel to the coupling conductor and is connected to the associated inner conductor terminals. Unrestricted movement of the leaf spring between the clamping slots is ensured by forming a widened cut-out in at least one of the coupling conductor and the conductor section.

In this arrangement a tiltable coupling conductor can once again face a rigid coupling conductor or, alternatively, two coupling conductors which are tiltable and parallel to one another can be used. Naturally this kind of tiltable mounting of the coupling conductor is not restricted to arrangements in which the inner terminal members lie on opposite sides of the associated clamping conductor but can also be used for a directional coupling in which the two terminal conductors associated with one coupling conductor both lie on the same side of that coupling conductor.

Figure 2:
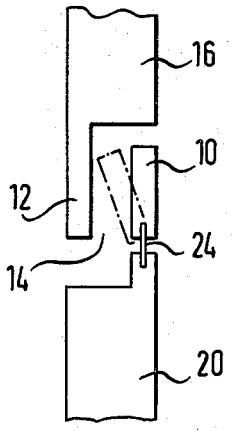
Figure 3:
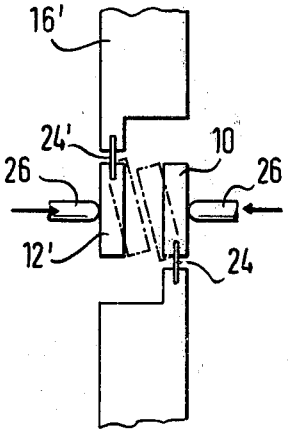
Figure 4:
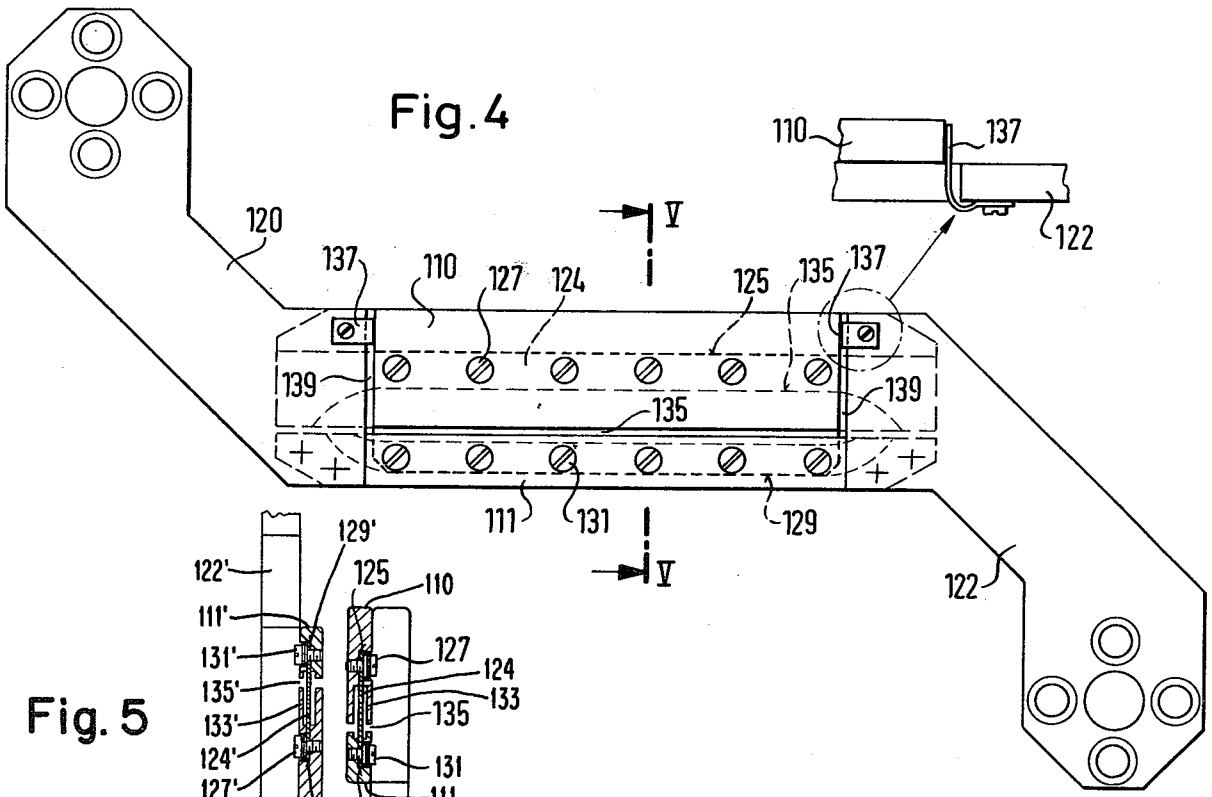
Figure 5:
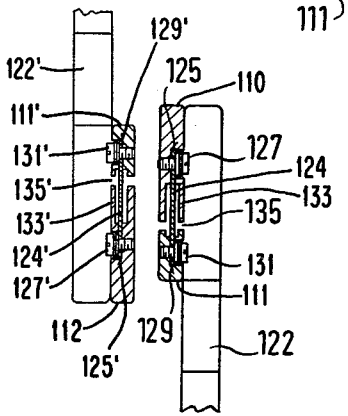

Embodiments of the invention will now be described in the following, by way of example only and with reference to the drawings, in which are shown:

FIG. 1 a schematic perspective illustration of the coupling conductors of a directional coupler constructed in accordance with the invention;

FIG. 2 a view in the direction of the arrow 2 of FIG. 1;

FIG. 3 a view corresponding to that of FIG. 2 of an embodiment in which both coupling conductors are tiltably arranged;

FIG. 4 a view of a coupling conductor with inner conductor terminals leaving the coupling conductor in opposite directions;

FIG. 5 a section on the line V—V of FIG. 4 and showing the complete coupler of that embodiment.

The drawings show only the inner conductor system of a coaxial directional coupler constructed in accordance with the invention. This system is surrounded, as in the embodiment shown in German Pat. No. 24 34 144, by an outer conductor system which has positioning members in order to be able to adjust the coupling gap by adjusting the position of the coupling conductors.

The coupling gap 14 is defined between the coupling conductors 10 and 12 and the coupling attenuation can be selected by adjusting the width of the coupling gap i.e. the mutual spacing of the coupling conductors. As can be seen from the embodiment FIGS. 1 and 2, the terminal ends 16, 18 of two inner conductors of two coaxial lines are rigidly connected to, or formed in one piece with, the two ends of the coupling conductor 12. As illustrated, the inner conductor terminals 16,18 extend in the same direction and are connected to the coupling conductor 12 from the same side and at right angles thereto. The inner conductor terminals could also be arranged on the same side of the coupling conductor 12 and be inclined thereto.

The coupling conductor 10 is tiltably connected, via respective leaf springs 24 which lie in the plane of the coupling gap parallel thereto, to the terminal ends 20,22 of two inner conductors of two coaxial guides which are arranged on the other side of the coupling gap. These leaf springs 24 make it possible for the coupling conductor 10 to tilt from the position shown in full lines to the position shown in chain dotted lines in FIG. 2. In the tilted position the coupling conductors admittedly no longer lie exactly parallel to one another, this can, however, be tolerated in many cases. If, however, a parallel position of the coupling conductors is required in every coupling position then the arrangement shown in FIG. 3 can be used. In the arrangement of FIG. 3 the coupling conductor 12' which lies opposite to the coupling conductor 10 is also tiltably connected to the adjoining coupling conductor 16', and to the corresponding inner conductor terminal at the other end of the coupling conductor 12', via leaf springs 24'. The parallelism of the two coupling conductors can be maintained for any width of the coupling gap by tilting the coupling conductors in the same sense which can be achieved by externally actuatable positioning members 26.

The embodiments of FIGS. 1 to 3 are suitable for a directional coupler in which the pairs of coaxial connection lines to each coupling conductor approach that conductor at an angle or at right angles from the same side or in which the connection lines extend in the direction of the coupling conductors. The embodiment of FIGS. 4 and 5 is a suitable for applications in which the coaxial connecting lines to each coupling conductor approach that coupling conductor from opposite directions. In this embodiment the coupling conductor 110 is tiltably connected via a leaf spring 124 to a rigid conductor section 111 which is disposed in the coupling zone and which is rigidly connected with inner conductor terminals 120 and 122, or formed in one piece with these inner conductor terminals, which extend away from the coupling conductor in opposite directions.

The spring 124 is clamped in slot 125 of the coupling conductor 110 by set screws 127. The other side of the leaf spring is clamped into a slot 129 of the conductor section 111 by set screws 131. In order to ensure free movability of the coupling conductor 110 the clamping slot is widened to a slot recess 133 between the clamping zones defined by screws 127 and 131 and a gap 135, which is bridged by the leaf spring 124, is provided between the facing edges of the coupling conductor 110 and the conductor section 111. In this way it is possible for the coupling conductor 110 to tilt freely via the leaf spring 124 when engaged by an appropriate positioning member. The re-setting of the coupling conductor usefully takes place through the re-setting force of the leaf spring 124.

FIGS. 4 and 5 show only a single coupling conductor. This coupling conductor co-operates with a second coupling conductor of mirror image symmetry which can be rigidly constructed in accordance with the embodiment of FIGS. 1 and 2 so that the coupling conductor 110 adopts an angle relative to this neighbouring coupling conductor when tilted. Alternatively, both coupling conductors can be constructed in accordance with FIGS. 4 and 5 so that they can both be tilted along the lines of the embodiment of FIG. 3 in such a manner that the parallelism of the coupling conductors is maintained and the coupling gap has the same width at all positions along the coupling conductors. FIG. 5 illustrates such a second coupling conductor 112 with mirror image symmetry, wherein all other elements corresponding to those of the first conductor 110 are similarly numbered with primed numbers. The galvanic connection between the terminal conductors and the coupling conductor 110 takes place via the leaf spring 124. In order to improve the galvanic contact, additional contact springs 137 can be provided with the additional contact springs being screwed to the rigid conductor sections and having angled sprung ends which project into the gap 139 between the coupling conductor 110 and the terminal conductor 122.

In the embodiment of FIGS. 4 and 5 the terminal conductors 120 and 122 are lead away to opposite sides of the coupling conductor. They could, however, be led away to the same side in the same manner as for the embodiments of FIGS. 1 to 3, i.e. the tiltable coupling conductor 110 could also be inserted into a conductor section rigidly connected to the associated inner conductor terminals 20,22, (this is not shown in the drawings). Clearly the coupling conductor associated with the second coupling conductor could also be connected in the same manner to the inner conductor terminals 16,18.

I claim:

1. A coaxial directional coupler, comprising:

a first and a second elongate coupling conductor guided in air, and each coupling conductor having a respective facing side facing toward the facing side of the other coupling conductor; an adjustable coupling air gap being defined between the facing sides of the coupling conductors;

for each of the coupling conductors, two respective inner conductor terminals are defined at separated locations along the respective coupling conductor; the inner conductor terminals are rigid and non-deformable and non-shiftable under mechanical force applied to the respective coupling conductors;

for at least one of the coupling conductors, resiliently deformable means are defined between both of the respective rigid inner conductor terminals and the coupling conductor, and the deformable means form tilting joints, and the tilting joints have axes which extend parallel to the axes of the coupling conductors and the axis of the air gap, whereby application of a mechanical force to the one coupling conductor will tilt it at the tilting joints for adjusting the air gap and the mutual separation of the coupling conductors.

2. Directional coupler according to claim 1, wherein the coupling conductors are of uniform width across their facing sides along their length between their respective inner conductor terminals.

3. Directional coupler according to claim 1, wherein the resiliently deformable means comprise leaf springs.

4. Directional coupler according to claim 3, wherein the coupling conductors have respective end portions and the leaf springs of at least one conductor are clamped in the end portions of the one conductor, and the leaf springs of the one conductor are also clamped in the respective inner conductor terminals.

5. Directional coupler according to either of claims 1 or 4 wherein only the one coupling conductor has respective deformable means while the other coupling conductor is rigid with its respective inner conductor terminals.

6. Directional coupler according to either of claims 1 or 4, wherein both of the coupling conductors have respective deformable means, whereby both may be tilted for adjusting the air gap.

7. Direction coupler according to claim 1, wherein the rigid inner conductor terminals for the one coupling conductor are spaced apart from each other and are joined by a rigid conductor section extending between them;

the one coupling conductor extending parallel to the rigid conductor section and the deformable means join the one coupling conductor to the inner conductor terminals by joining the one coupling conductor to the respective rigid conductor section.

8. Directional coupler according to claim 7, wherein the one coupling conductor has a first clamping slot opening toward the rigid conductor section, and the rigid conductor section has a second clamping slot opening toward the coupling conductor; the deformable means comprise a leaf spring and the leaf spring has opposite sides extending into and clamped in the first and second clamping slots, respectively.

9. Directional coupler according to claim 8, wherein in the vicinity of at least one of the first and second clamping slots, a widened cut-out is defined for permitting freer movement of the leaf spring in the cut-out.

10. Directional coupler according to claim 9, wherein the coupling conductor and the rigid conductor section are spaced apart to define a gap between them for allowing relative movement between them at the fitting joint.

11. Directional coupler according to any of claims 7, 9 or 10, wherein the one coupling conductor has end faces at the axial ends thereof and coupler further comprises additional contact springs between the end faces of the one coupling conductor and the respective inner conductor terminals of that coupling conductor which terminals are near the respective end faces of the one coupling conductor, whereby as the one coupling conductor tilts with respect to the rigid conductor section, the additional contact springs maintain electrical contact.

12. Directional conductor according to claim 7, wherein the inner conductor terminals of the one coupling conductor extend in respective opposite directions away from the axis of the one coupling conductor.

13. Directional coupler according to either of claims 7 or 8, wherein the deformable means extends between the one coupling conductor and the rigid conductor section along a substantial part of the length of the one coupling conductor.

14. Directional coupling according to any of claims 1, 3 or 7, further comprising means movable into engagement with the one coupling conductor for tilting the same at the respective deformable means thereof.

* * * * *